US005187834A

United States Patent [19]

Stark

[11] Patent Number: 5,187,834

[45] Date of Patent: Feb. 23, 1993

[54] VACUUM CLEANER APPARATUS

[76] Inventor: Arthur E. Stark, 3708 Lost Oasis Hollow, Austin, Tex. 78703

[21] Appl. No.: 797,449

[22] Filed: Nov. 21, 1991

[51] Int. Cl.[5] ..... A47L 9/06

[52] U.S. Cl. ..... 15/398; 15/322; 15/415.1

[58] Field of Search ..... 15/398, 364, 321, 415.1

[56] References Cited

U.S. PATENT DOCUMENTS

| | | | |
|---|---|---|---|
| 2,607,863 | 8/1952 | MacFarland | 15/144 B X |
| 3,745,605 | 7/1973 | Gitschel et al. | 15/400 |
| 3,820,189 | 6/1974 | Roth | 15/400 |
| 3,833,962 | 9/1974 | Krusche | 15/400 |
| 4,053,962 | 10/1977 | McDowell | 15/415.1 |
| 4,319,379 | 3/1982 | Carrigan et al. | 15/400 |
| 4,524,484 | 6/1985 | Graham | 15/144 B X |

*Primary Examiner*—Chris K. Moore
*Attorney, Agent, or Firm*—Leon Gilden

[57] ABSTRACT

A vacuum cleaner apparatus and improved brush housing therefore are provided, wherein the brush housing includes a central inlet directed medially between side walls of the brush housing, with a first and second brush member positioned forwardly and rearwardly of the inlet, wherein the first brush and the second brush include a respective first and second bristle brush matrix, wherein the first brush matrix is canted rearwardly relative to the inlet and the second brush is directed forwardly relative to the inlet to effect trapping of particles for their projection into the brush housing.

1 Claim, 5 Drawing Sheets

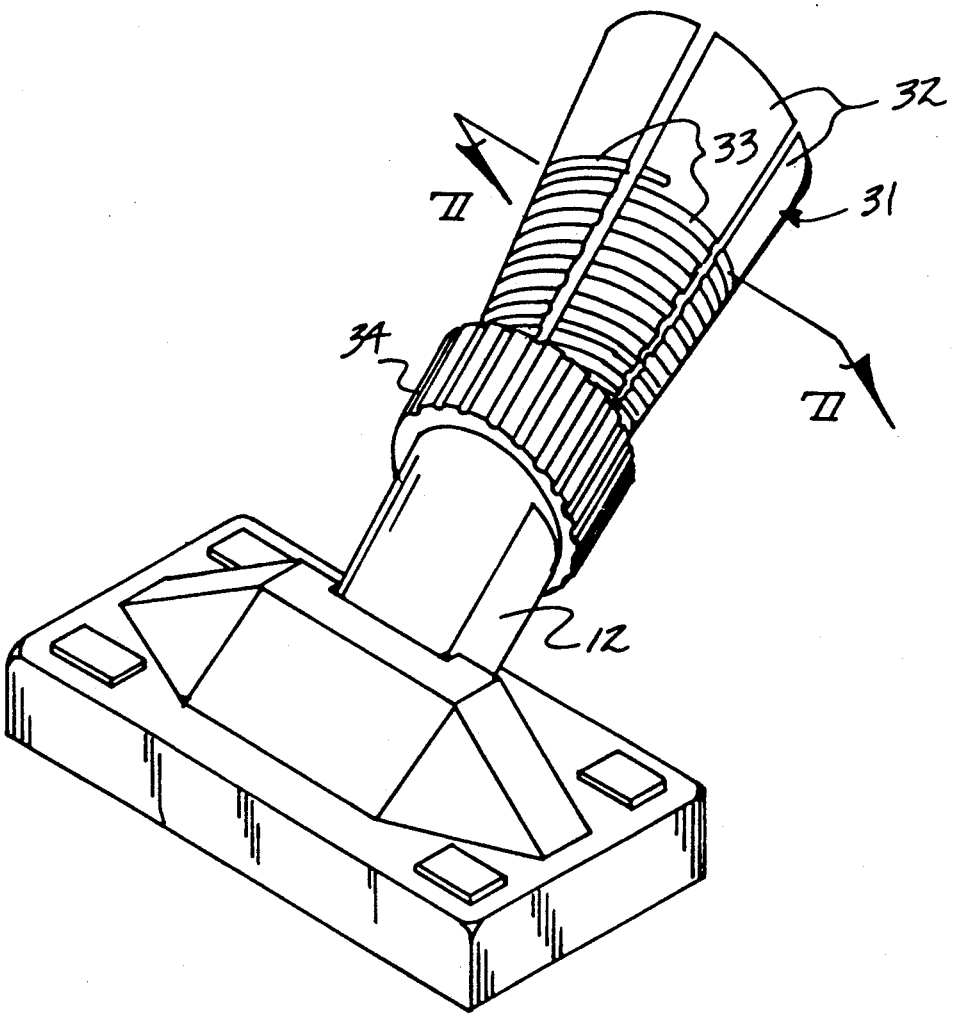
Fig 6
Fig 7
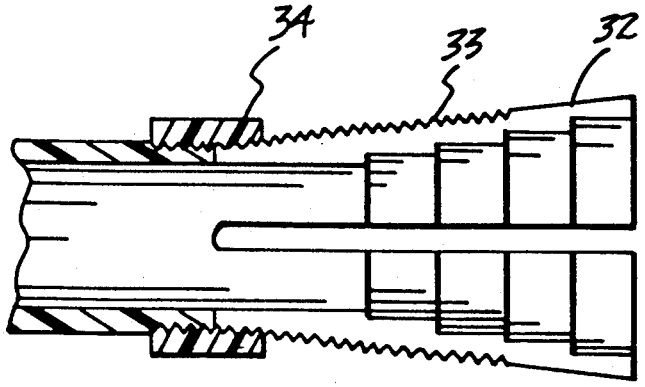

VACUUM CLEANER APPARATUS

BACKGROUND OF THE INVENTION

1. Field of the Invention

The field of invention relates to vacuum cleaner apparatus, and more particularly pertains to a new and improved vacuum cleaner apparatus wherein the same provides for an improved brush housing to direct debris interiorly of an associated vacuum cleaner.

2. Description of the Prior Art

Vacuum cleaner apparatus of various types have been utilized in the prior art to direct debris into an associated vacuum cleaner Such apparatus is exemplified in U.S. Pat. No. 4,955,102 to Cousins wherein a vacuum cleaner beater brush includes a helical brush construction arranged to direct debris interiorly of an associated housing.

U.S. Pat. No. 4,847,944 to Lackner sets forth a vacuum cleaner utilizing a power brush roll providing zero clearance to prevent string or other debris from entering a bearing structure of the brush housing.

U.S. Pat. No. 4,850,077 to Venturini utilizing a plurality of brush rolls mounted within a housing.

As such, it may be appreciated that there continues to be a need for a new and improved vacuum cleaner apparatus as set forth by the instant invention which addresses both the problems of ease of use as well as effectiveness in construction in providing for simplicity in organization to utilize a brush housing to accumulate debris for interiorly of an associated vacuum cleaner apparatus and in this respect, the present invention substantially fulfills this need.

SUMMARY OF THE INVENTION

In view of the foregoing disadvantages inherent in the known types of vacuum cleaner apparatus now present in the prior art, the present invention provides a vacuum cleaner apparatus wherein the same utilizes a forward and rear brush head utilizing canted bristles directed towards a central opening to direct debris interiorly of the associated vacuum cleaner. As such, the general purpose of the present invention, which will be described subsequently in greater detail, is to provide a new and improved vacuum cleaner apparatus which has all the advantages of the prior art vacuum cleaner apparatus and none of the disadvantages.

To attain this, the present invention provides a vacuum cleaner apparatus and improved brush housing therefore, wherein the brush housing includes a central inlet directed medially between side walls of the brush housing, with a first and second brush member positioned forwardly and rearwardly of the inlet, wherein the first brush and the second brush include a respective first and second bristle brush matrix, wherein the first brush matrix is canted rearwardly relative to the inlet and the second brush is directed forwardly relative to the inlet to effect trapping of particles for their projection into the brush housing.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved vacuum cleaner apparatus which has all the advantages of the prior art vacuum cleaner apparatus and none of the disadvantages.

It is another object of the present invention to provide a new and improved vacuum cleaner apparatus which may be easily and efficiently manufactured and marketed.

It is a further object of the present invention to provide a new and improved vacuum cleaner apparatus which is of a durable and reliable construction.

An even further object of the present invention is to provide a new and improved vacuum cleaner apparatus which is susceptible of a low cost of manufacture with regard to both materials and labor, and which accordingly is then susceptible of low prices of sale to the consuming public, thereby making such vacuum cleaner apparatus economically available to the buying public.

Still yet another object of the present invention is to provide a new and improved vacuum cleaner apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an isometric illustration of a modified collet structure utilized by the brush housing.

FIG. 7 is an orthographic view, taken along the lines 7—7 of FIG. 6 in the direction indicated by the arrows.

DESCRIPTION OF THE PREFERRED EMBODIMENT

Figure 1:
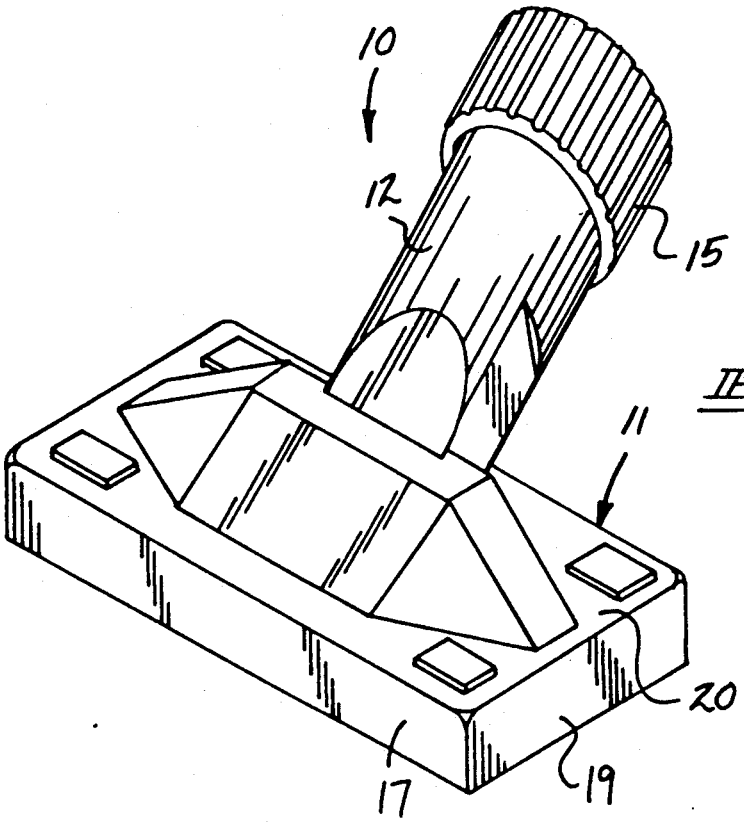
FIG. 1 is an isometric illustration of the instant invention.

With reference now to the drawings, and in particular to FIGS. 1 to 9 thereof, a new and improved vacuum cleaner apparatus embodying the principles and concepts of the present invention and generally designated by the reference numerals 10 and 10*a* will be described.

More specifically, the vacuum cleaner apparatus 10 of the instant invention essentially comprises a brush housing 11 defined by a housing front wall 17 spaced from a housing rear wall 18, with spaced parallel side walls 19 directed between the front and rear walls, as illustrated. A housing top wall 20 includes a connection conduit 12 mounted thereto, wherein the connection conduit 12 projects medially of the top wall 20 and includes collet fingers 13 formed at a rear distal end of the connection conduit 12. The collet fingers 13 are formed of a deflectable shape retentent material and include a threaded connection portion 14 positioned adjacent the collet fingers 13 about the conduit 12 cooperative with a collet cap 15 that includes a collet cap bore 16 and internally threaded skirt for cooperation with the threaded connection portion 14.

A first brush member 22 and a second brush member 23 are directed coextensively between the side walls 19, with the first brush member 22 positioned adjacent the front wall 17, with the second brush member 23 positioned adjacent the rear wall 18 defining a central entrance opening 21 therebetween aligned with the connection conduit 12. The first brush member 22 includes a matrix of first brush bristles 24, with the second brush member 23 including a matrix of second brush bristles 25. The first brush bristles 24 are canted rearwardly towards the central entrance opening 21 and defining a substantially forty-five degree included angle between the first bristles 24 and the first brush member base 22*a*. The second brush bristles 25 define a substantial forty-five degree angle between a second brush base 23*a*, wherein forward projection of the brush housing directs debris past the first brush bristles 24, but captured by the second brush bristles, wherein conversely rearward projection of the brush housing captures debris upon the first brush member bristles 24 to thereby contain such debris relative to the entrance opening 21 for its projection within the connection conduit 12 operatively associated with the vacuum source of conventional construction. A plurality of first openings 28 receive a plurality of first alignment boss members 26 mounted to a top wall of the first brush member 22, wherein a plurality of second openings 29 within the top wall 20 receive respective second alignment boss members 27 mounted to the second brush member 23. It should be understood, however, that in alignment and positioning of each brush member within the brush housing 11, the bristles 24 and 25 project below the front, rear, and side walls 17, 18, and 19 respectively.

The collet structure of the FIGS. 6 and 7 defines a conical collet 31, including spring fingers 32 formed with spring finger threaded portions 33 positioned adjacent lower portions of each spring finger cooperative with an internally threaded clamping ring 34 for securement of a connection conduit thereto.

Figure 3A:
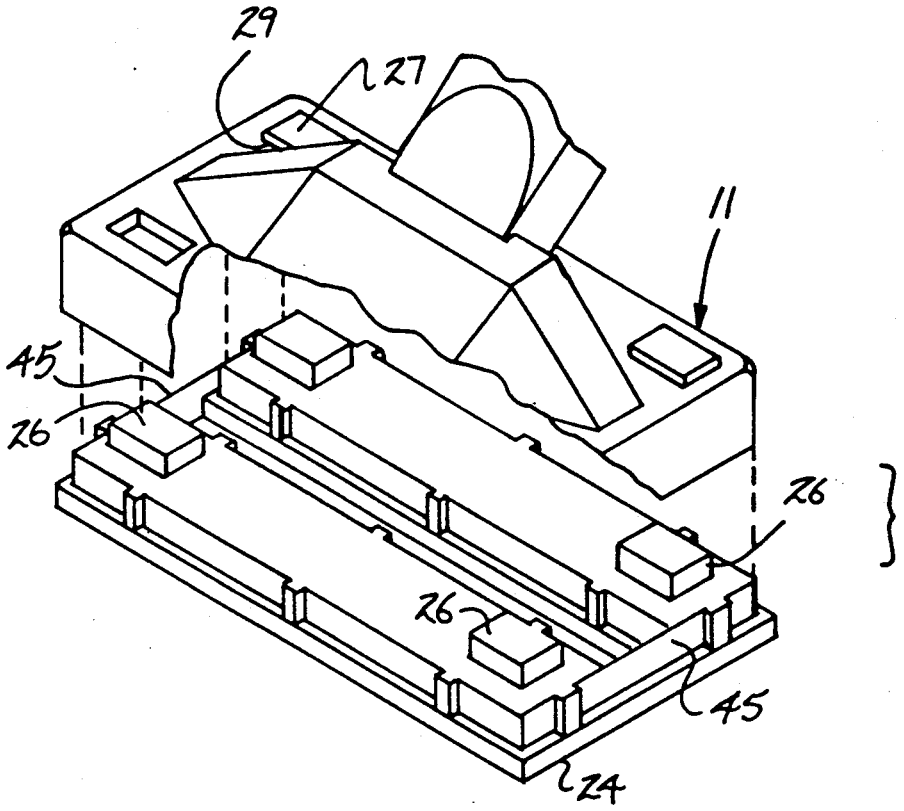
FIG. 3*a* is an isometric illustration of a modified brush assembly, wherein a plurality of spaced, parallel brush heads of unitary construction are arranged for securement into the associated brush housing.

Reference to FIG. 3*a* illustrates the brush housing 11 to include the use of a unitary brush bristle surface 24 forming an opening therethrough for receiving an associated agitator brush therebetween, wherein spaced parallel securement side wall panels 45 secure the organization together permitting ease of installation and removal of the brush head structure as a unit relative to the housing permitting ease of replacement of assembly of the organization as an alternative form in use of the brush assemblies. It should be further noted that the instant invention may be formed wherein the housing 11 is of a unitary construction, with the conduit 12 directed into the housing and through the top wall 20 thereof at forty-five degrees, wherein the housing is thereby formed of a unitary construction for ease of manufacturing and the like. Further, it should be understood that the organization may be formed of various sizes to accommodate various cleaning procedures, such as the cleaning of furniture and the like, requiring lessened dimensions permitting ease of maneuvering and use of the organization.

Figure 2A:
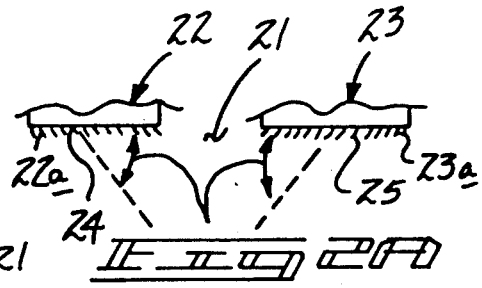
FIG. 2*a* is an orthographic view, taken along the lines 2*a*—2*a* of FIG. 2 in the direction indicated by the arrows.
Figure 2:
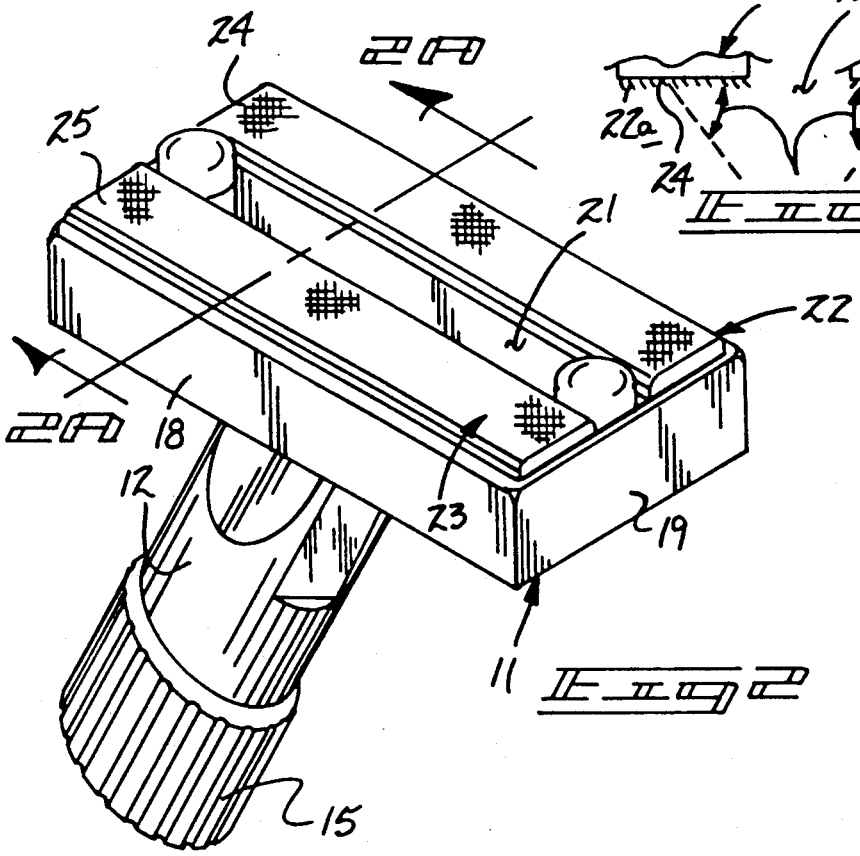
FIG. 2 is an isometric illustration of a bottom view of the instant invention.
Figure 3:
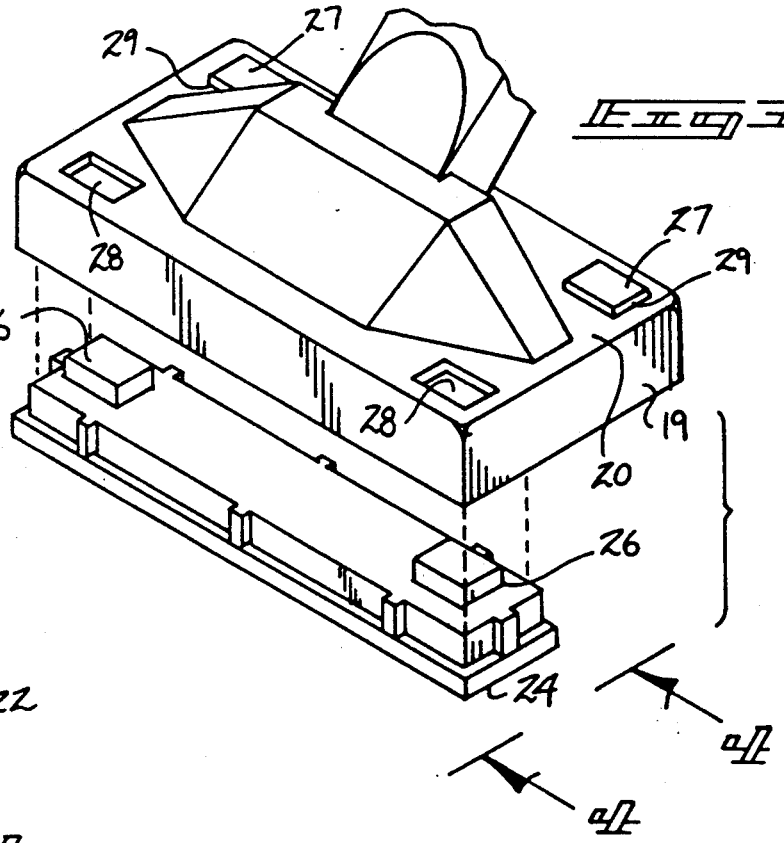
FIG. 3 is an isometric illustration of the brush housing with a brush member separated therefrom.
Figure 4A:
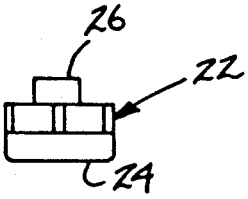
FIG. 4 is an orthographic view, taken along the lines 4—4 of FIG. 3 in the direction indicated arrows.
Figure 5:
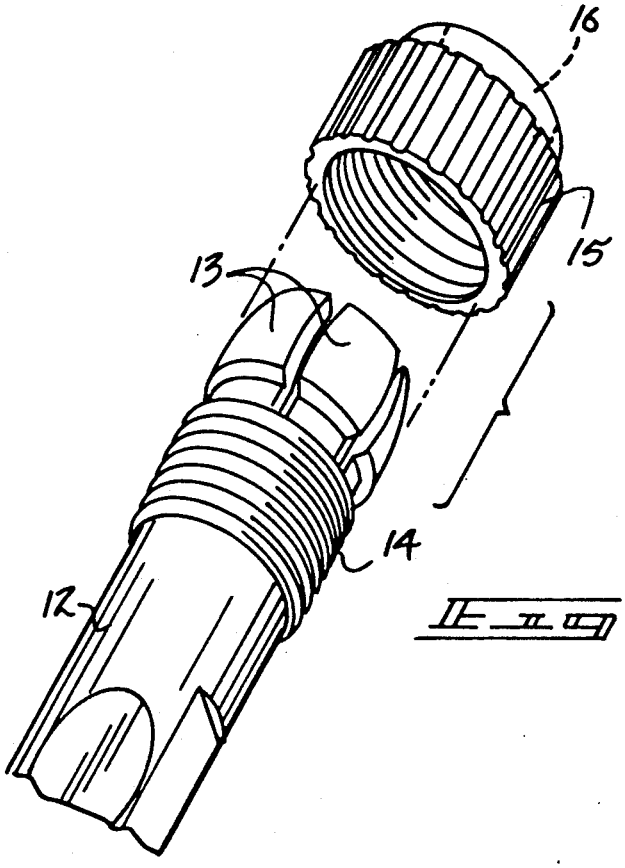
FIG. 5 is an isometric illustration of the collet structure utilized by the brush housing.
Figure 8B:
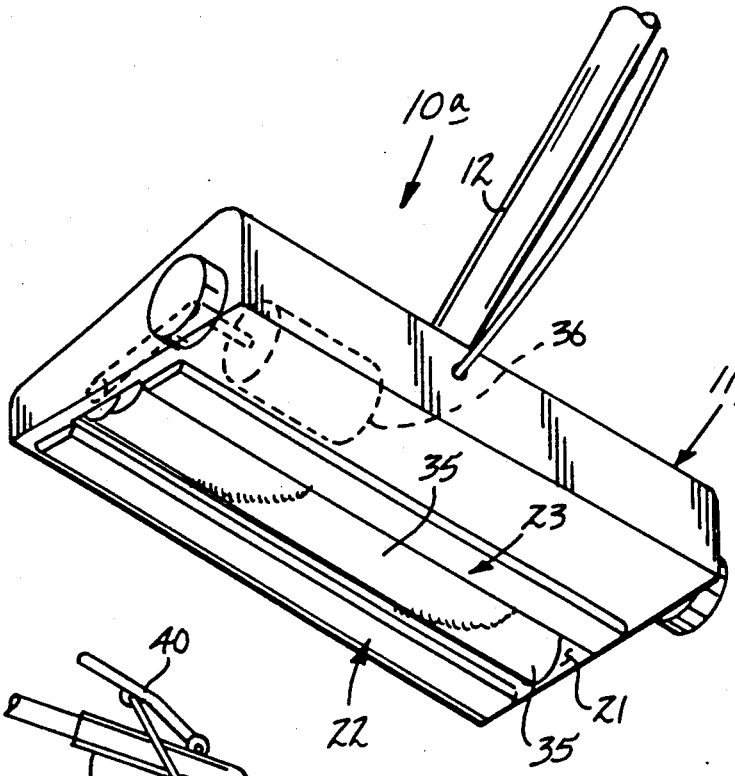
FIG. 8 is an isometric illustration of a modified brush housing utilized by the instant invention.
Figure 9:
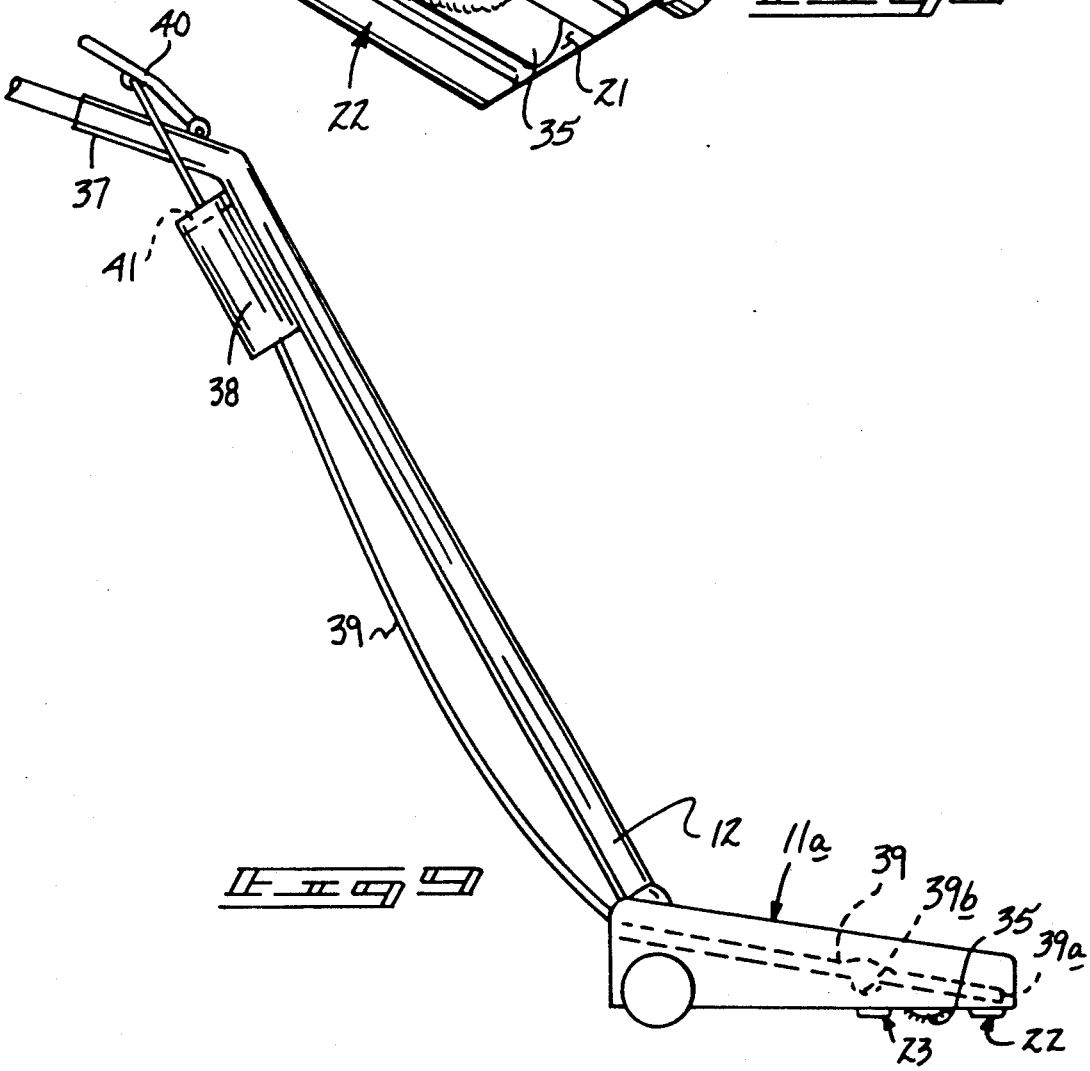
FIG. 9 is an orthographic side view of the modified vacuum cleaner structure utilized by the invention, as illustrated in FIG. 8.

The modified apparatus 10*a* illustrates a modified brush housing 11*a* of construction as described relative to the organization of the FIGS. 1–3, but including an agitator brush 35 rotatably mounted between the first and second brush members 22 and 23. The agitator brush 35 is rotated relative to the brush housing by an agitator brush drive motor 36. Further, with reference to FIG. 9, the conduit 12 includes a conduit handle 37, including a deodorizing fluid reservoir 38 positioned adjacent thereto, with a deodorizing fluid reservoir conduit 39 directed from the reservoir 38 into the housing 11*a*, and including a respective first and second outlet 39*a* and 39*b* positioned above the respective first and second brush members 22 and 23 for directing a deodorizing fluid to be absorbed into the first and second brush members to deodorize and minimize undesirable odors emanating from the brush housing structure 11*a*. A pump handle 40 mounted pivotally relative to the conduit handle 37 is secured to a pump handle piston 41 contained within the reservoir 38 to pressurize the reservoir conduit 39 in use and thereby direct the deodorizing fluid as noted above into the first and second outlets 39*a* and 39*b*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A vacuum cleaner brush housing for operative association with a vacuum cleaner, wherein the brush housing comprises, a brush housing front wall, a brush housing rear wall, spaced brush housing side walls, and a brush housing top wall, with the brush housing top wall including a connection conduit directed into the brush housing top wall, wherein the connection conduit is in pneumatic communication interiorly of the brush housing, and the brush housing including a first brush member within the brush housing positioned coextensively between the side walls and in contiguous communication with the front wall, and a second brush member spaced from the first member extending coextensively between the side walls and in pneumatic sealed communication with the rear wall, and the first brush member and the second brush member defining a central entrance opening directed between the first brush member and the second brush member positioned below the connection conduit, with the first brush member including a first brush bristle matrix extending below the front wall and the side walls, and the second brush member including a second brush bristle matrix extending below the side walls and the rear wall, and the first brush bristle matrix is canted rearwardly towards the central entrance opening, and the second brush bristle matrix is canted forwardly towards the central brush bristle matrix, and the first brush member includes a first brush member base mounting the first brush member matrix, and the second brush member includes a second brush member base mounted to the second brush bristle matrix, and first brush bristles of said first brush bristle matrix define a forty-five degree included angle between the first brush bristles and the first brush member base, and second brush bristles of the second brush bristle matrix define an acute included angle between the second brush bristles and the second brush member base, and said acute angle defines essentially forty-five degrees, and the top wall includes a plurality of first openings adjacent the front wall, and includes a plurality of second openings positioned adjacent the rear wall, and the first brush member includes a plurality of first brush member bosses, wherein the first brush member bosses are received within the first openings, and the second brush member includes a plurality of second brush member bosses, wherein the second brush member bosses are received within the second openings, and the connection conduit includes a plurality of spring fingers, the spring fingers include a lower threaded end portion, and an internally threaded cap securable about the threaded portion for securement of the conduit to a further conduit, and the spring fingers define a conical configuration, and the central entrance opening includes an agitator brush rotatably mounted therewithin extending coextensively between the first brush member and the second brush member, and the agitator brush includes a helical brush member mounted thereon, and the brush is rotatably directed to include a drive motor to effect rotation of the agitator brush, and the connection conduit includes a deodorizing fluid reservoir, and pump handle mounted to the connection conduit, wherein the pump handle includes a pump handle piston received within the reservoir for effecting pressurizing of the reservoir, and a reservoir conduit directed from the reservoir into the brush housing, the reservoir conduit including a first outlet positioned above the first brush member and the reservoir conduit including a second outlet positioned above the second brush member to direct a deodorizing fluid onto the first brush member and the second brush member.

* * * * *